US008393707B2

(12) United States Patent
Cudzinovic et al.

(10) Patent No.: US 8,393,707 B2
(45) Date of Patent: Mar. 12, 2013

(54) APPARATUSES AND METHODS FOR REMOVAL OF INK BUILDUP

(75) Inventors: Michael Cudzinovic, Sunnyvale, CA (US); Thomas Pass, San Jose, CA (US); Rob Rogers, Santa Clara, CA (US); Ray-Hon Sun, Palo Alto, CA (US); Sheng Sun, Foster City, CA (US); Ben Wahlstrom, Albany, OR (US); Dennis Jason Fuhrman, Corvallis, OR (US); Kyle David Altendorf, Corvallis, OR (US)

(73) Assignee: SunPower Corporation, San Jose, CA (US)

( * ) Notice: Subject to any disclaimer, the term of this patent is extended or adjusted under 35 U.S.C. 154(b) by 267 days.

(21) Appl. No.: 12/862,086

(22) Filed: Aug. 24, 2010

(65) Prior Publication Data

US 2012/0050374 A1 Mar. 1, 2012

(51) Int. Cl.
*B41J 29/38* (2006.01)

(52) U.S. Cl. ..... 347/17

(58) Field of Classification Search ..... 347/6, 17, 347/90, 104

See application file for complete search history.

(56) References Cited

U.S. PATENT DOCUMENTS

| | | | | |
|---|---|---|---|---|
| 6,141,026 | A * | 10/2000 | Domoto et al. | 347/140 |
| 6,473,583 | B2 * | 10/2002 | Watanabe | 399/237 |
| 6,938,547 | B1 | 9/2005 | Cecil | |
| 7,253,017 | B1 | 8/2007 | Roscheisen et al. | |
| 7,524,040 | B2 | 4/2009 | Kusakari | |
| 2003/0160026 | A1 | 8/2003 | Klein et al. | |
| 2003/0175411 | A1 | 9/2003 | Kodas et al. | |
| 2004/0145643 | A1 | 7/2004 | Nakamura | |
| 2005/0109238 | A1 | 5/2005 | Yamaki et al. | |
| 2007/0151599 | A1 | 7/2007 | Cousins | |
| 2009/0092745 | A1 | 4/2009 | Pavani et al. | |

OTHER PUBLICATIONS

"International Application No. PCT/US2008/076453, International Search Report mailed Nov. 21, 2008", 2 pgs.

* cited by examiner

*Primary Examiner* — An Do

(74) *Attorney, Agent, or Firm* — Blakely Sokoloff Taylor Zafman LLP

(57) ABSTRACT

A substrate patterning method including the steps of spraying ink on a surface of a substrate, the spraying of the ink resulting in an overspray of excess ink past an edge of the substrate; changing a temperature of the excess ink to cause a change in a viscosity of the excess ink; and removing the excess ink having the changed viscosity.

6 Claims, 9 Drawing Sheets

APPARATUSES AND METHODS FOR REMOVAL OF INK BUILDUP

GOVERNMENT FUNDING

The invention described herein was made with Governmental support under contract number DE-FC36-07GO17043 awarded by the United States Department of Energy. The Government may have certain rights in the invention.

FIELD

The present disclosure relates generally to the fabrication of electronics. In an embodiment, the disclosure relates to apparatuses and methods for removal of ink buildup.

BACKGROUND

In general, inkjet heads are designed to deposit small droplets of ink in a defined, repeatable pattern. A wide variety of inkjet technologies are currently used in the fabrication of electronics. For example, inkjet heads deposit a wide variety of materials (e.g., semiconductor materials, dielectrics, and metal inks) on a wide variety of substrate types to create "printed" electronics.

When printing materials on a substrate, ink ejected by an inkjet head can build up or accumulate outside of the substrate. For example, the inkjet head can spray a small amount of ink past an edge of a substrate. If the ink is non-flowing at room temperature, it can accumulate and form a buildup over time. Such a buildup of ink can cause contamination of the substrate and can also cause uneven distribution of the ink. Such contamination and uneven distribution can cause defects in the electronics and mechanical yield loss in electronics fabrication.

SUMMARY

In an embodiment, a substrate patterning apparatus is provided. The substrate patterning apparatus includes an inkjet head configured to spray ink on a surface of a photovoltaic substrate. The spray of the ink results in an overspray of excess ink past an edge of the photovoltaic substrate. Also included is a chuck assembly disposed below the inkjet head and configured to support the photovoltaic substrate. The substrate patterning apparatus also includes a collector that is proximate to the edge of the photovoltaic substrate and disposed below the photovoltaic substrate. Here, the collector is configured to collect the excess ink. Additionally included in the substrate patterning apparatus is a heater proximate to the collector and configured to heat the excess ink.

In another embodiment, a substrate patterning method is provided. In this method, ink is sprayed on a surface of a substrate. Here, the spray results in an overspray of excess ink past an edge of the substrate. A temperature of the excess ink is changed to cause a change in a viscosity of the excess ink, and after the temperature change, the excess ink having the changed viscosity is removed.

In yet another embodiment, a chuck assembly to support a semiconductor substrate is provided. The chuck assembly includes a chuck, a trough disposed below the chuck, and a heater proximate to the trough. The chuck is configured to support the semiconductor substrate while the trough is configured to collect an overspray of excess ink sprayed past an edge of the semiconductor substrate. The heater is configured to heat the trough.

BRIEF DESCRIPTION OF DRAWINGS

The present disclosure is illustrated by way of example and not limitation in the figures of the accompanying drawings, in which like references indicate similar elements and in which.

DETAILED DESCRIPTION

The following description and the drawings illustrate specific embodiments of the invention sufficiently to enable those skilled in the art to practice them. Other embodiments can incorporate structural, logical, electrical, process, and other changes. Examples merely typify possible variations. Individual components and functions are optional unless explicitly required, and the sequence of operations can vary. Portions and features of some embodiments can be included in or substituted for those of others. Embodiments of the invention set forth in the claims encompass all available equivalents of those claims. Embodiments of the invention can be referred to, individually or collectively, herein by the term "invention" merely for convenience and without intending to limit the scope of this application to any single invention or inventive concept if more than one is in fact disclosed.

Figure 1A:
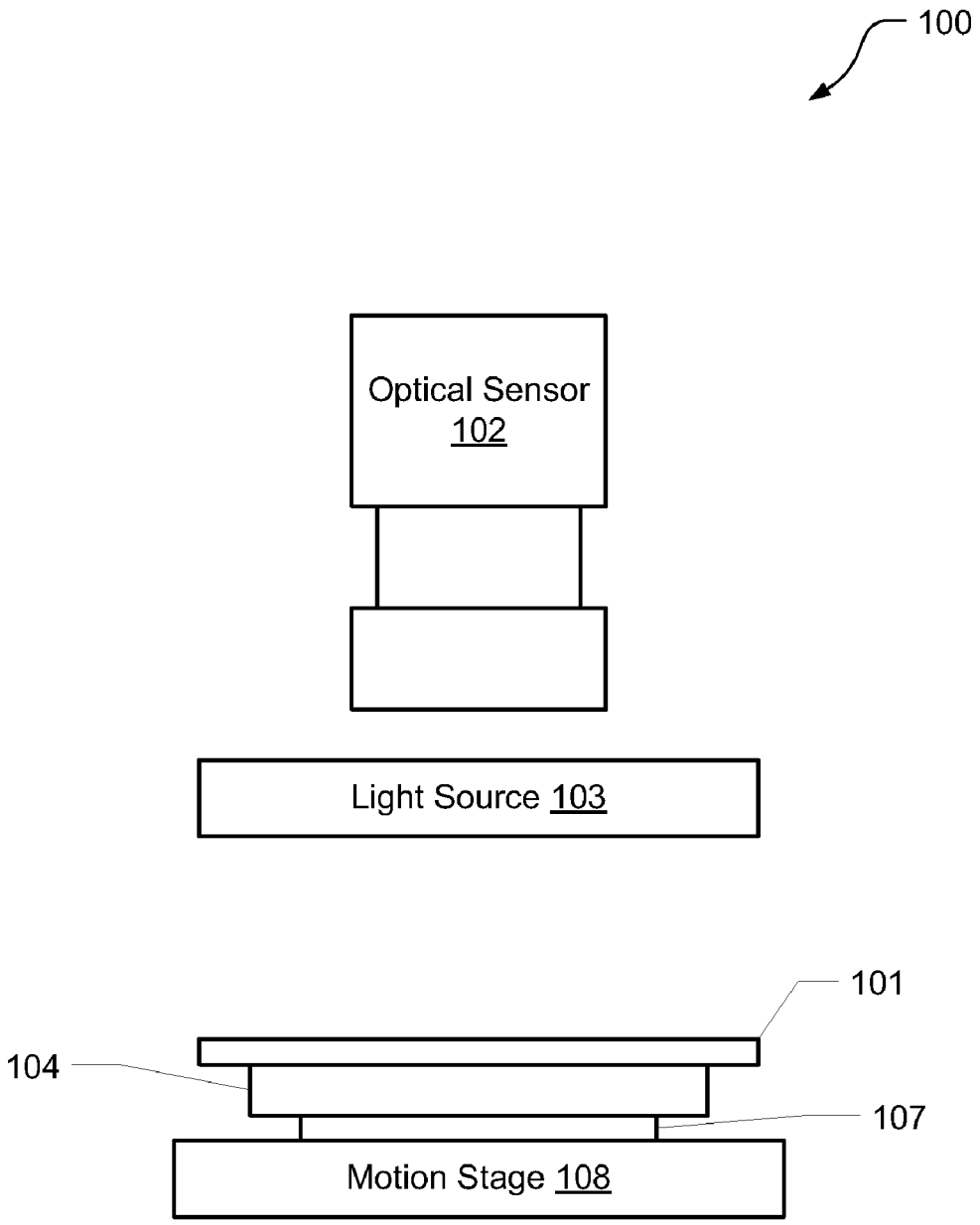
FIGS. 1A and 1B depict an example of a substrate patterning apparatus, in accordance with an example embodiment.
Figure 1B:
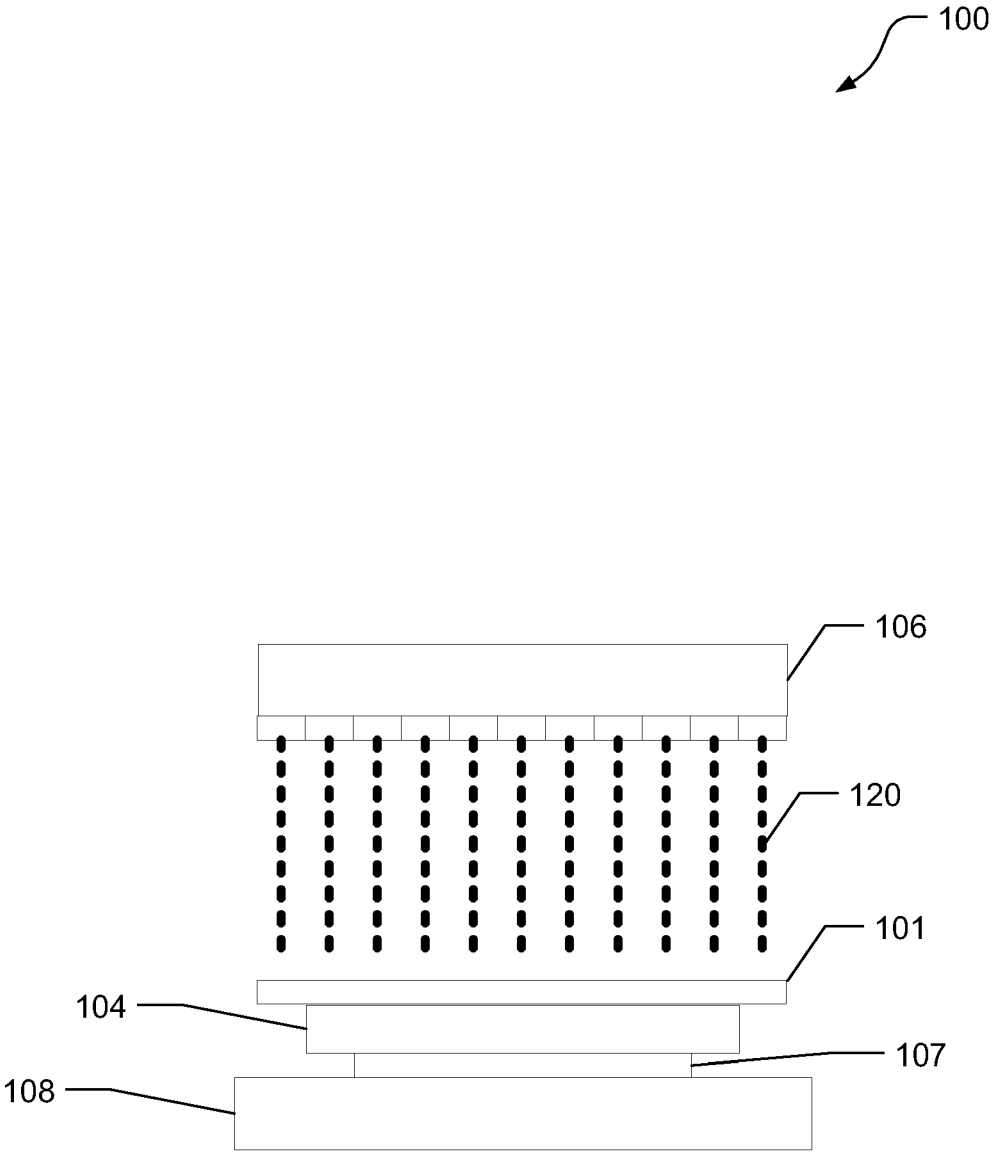

FIGS. 1A and 1B depict an example of a substrate patterning apparatus 100, in accordance with an example embodiment. As depicted in FIG. 1A, the substrate patterning apparatus 100 includes a chuck assembly 104, a support structure 107, an optical sensor 102, a light source 103, and a motion stage 108. The chuck assembly 104 is disposed below the optical sensor 102 supports a substrate 101. As used herein, a "substrate" 101 refers to a physical material upon which an electronic device (e.g., a photovoltaic cell, a transistor, a capacitor, and other devices) is applied. Examples of substrates include a sheet of glass, a photovoltaic substrate, a sheet of film, and a semiconductor substrate.

The chuck assembly 104 is disposed above a support structure 107 that retrieves and positions the substrate 101 below the optical sensor 102. An example of the support structure 107 is a linear slide that picks up the substrate 101 from a conveyor belt and slides the substrate 101 below the inkjet head 106.

The optical sensor 102 (e.g., a camera) proximate to the top surface of the substrate 101 can be disposed above the chuck assembly 104 (and the substrate 101) and can capture an image of the top surface of the substrate 101. In the embodiment depicted in FIG. 1A, the light source 103 provides the light to illuminate the substrate 101 such that the image of the substrate 101 can be captured. That is, the light source 103 can be the light origin that emits light or other electromagnetic radiation. Examples of the light source 103 include lasers, light-emitting diodes, and light bulbs. However, as explained below, the light source 103, in an alternate embodiment, can refer to a reflector of light or other electromagnetic radiation. The substrate patterning apparatus 100 can use this captured image, for example, to position the substrate 101 at a predefined position below the inkjet head 106, or can use the captured image for quality control purposes. After the optical sensor 102 captures the image of the substrate 101, the motion stage 108, which supports the support structure 107, moves the substrate 101 to another station of the substrate patterning apparatus 100, as depicted in FIG. 1B.

As depicted in FIG. 1B, this different station of the same substrate patterning apparatus 100 includes an inkjet head 106 as well as the above-discussed assembly of substrate 101, chuck assembly 104, support structure 107, and motion stage 108. The inkjet head 106 sprays ink 120 on a top surface of the substrate 101. The ink 120 used in electronics fabrication can be comprised of a variety of different materials. In one example, the ink 120 sprayed by the inkjet head 106 is comprised of a wax that is used as a masking material in integrated circuit fabrication, such as an etching process or electroplating process. Such a wax refers generally to a class of substances that are malleable (or plastic) at normal ambient temperatures, have a melting point above approximately 45° C., have a relatively low viscosity when melted, are insoluble in water, and are hydrophobic. Examples of waxes include microcrystalline waxes, fatty amide waxes, and oxidized Fischer-Tropsch waxes. In addition to wax, other examples include inks comprised of semiconductor materials, metallic materials, dielectric materials, polymer materials, and other materials.

When the inkjet head 106 sprays (or prints) ink 120 on the top surface of the substrate 101, the spray of ink 120 results in an overspray past an edge of the substrate 101. To prevent a buildup of excess ink from the overspray, a temperature of the excess ink from the overspray is changed. The resulting temperature change causes a change in the viscosity of the excess ink. A collector (not shown) disposed below the edge of the substrate 101 collects the excess ink. As explained in more detail below, the change in viscosity of the excess ink allows the excess ink from the overspray to be removed, thereby preventing ink buildup.

It should be appreciated that the substrate patterning apparatus 100 can be used in the fabrication of semiconducting devices, such as photovoltaic cells. Here, the substrate patterning apparatus 100 can have a high throughput, such as a rate of 18,000 cells/hour, and yet can print with high levels of precision to create highly refined etch masks or electronic devices. Although the embodiment depicted in FIGS. 1A and 1B depicts the inkjet head 106 disposed above the substrate 101, the substrate 101 can also be oriented in different orientations. For example, the substrate 101 can be oriented sideways or vertically where the inkjet head 106 is also be oriented sideways along a plane substantially parallel to a surface of the substrate 101.

Figure 2:
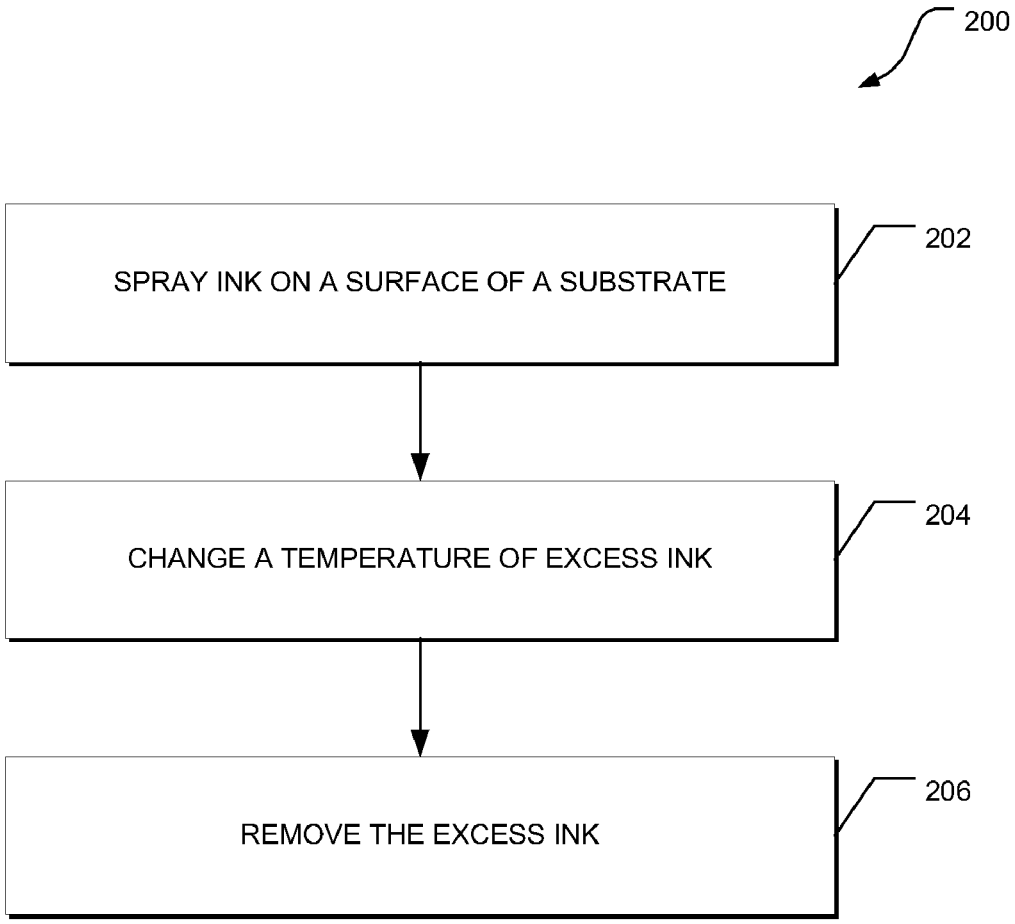
FIG. 2 depicts a flow diagram of a general overview of a substrate patterning method, in accordance with an embodiment.

FIG. 2 depicts a flow diagram of a general overview of a substrate patterning method 200, in accordance with an embodiment. The substrate patterning method 200 can, for example, be implemented by the substrate patterning apparatus 100 of FIG. 1. As depicted in FIG. 2, an inkjet head sprays ink at 202 on a surface of a substrate, and the spray results in an overspray of excess ink past an edge of the substrate. At 204, the temperature of the excess ink is changed to cause a change in a viscosity of the excess ink. It should be appreciated that viscosity varies with temperature. In one embodiment, the excess ink is heated. In another embodiment, the excess ink is cooled. The changing of the temperature of excess ink can cause a phase of the excess ink to change from one phase to a different phase. For example, the excess ink can be changed from a solid phase to a liquid phase when heated. In another example, the excess ink can be changed from a liquid phase to a solid phase when cooled.

The change in viscosity of the excess ink can facilitate the removal of the excess ink at 206 to prevent ink buildup. In one embodiment, the excess ink can be removed by applying a vacuum to draw away the excess ink having the changed viscosity, as will be explained in more detail below. In another embodiment, the excess ink can be removed by applying a current of air to the excess ink. For example, a blast of air can be applied to the excess ink. It should be appreciated that the removal of the excess ink can not involve the application of a physical force (e.g., the vacuum or application of air) to the excess ink. In an alternate embodiment, the excess ink can also be removed by gravitational forces, such as allowing the excess ink to fall or flow away from a chuck assembly based on gravity.

Figure 3:
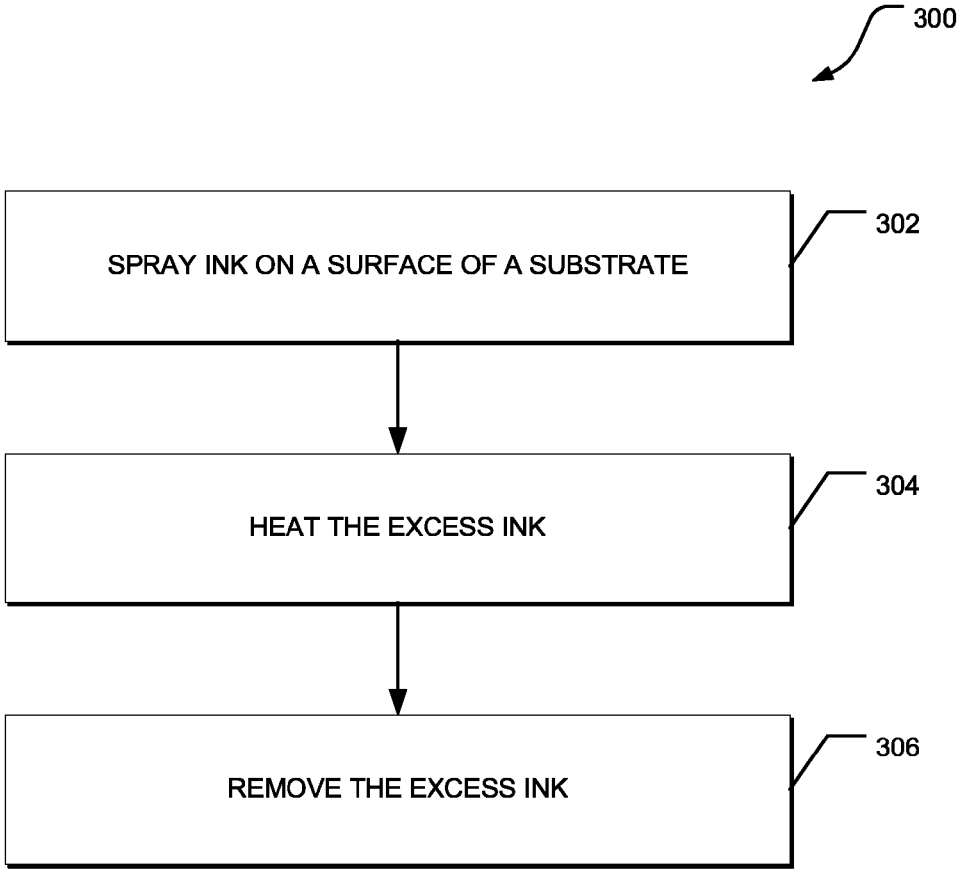
FIG. 3 depicts a flow diagram of a general overview of a substrate patterning method based on heating the excess ink, in accordance with a more detailed embodiment.

FIG. 3 depicts a flow diagram of a general overview of a substrate patterning method 300 based on heating the excess ink, in accordance with a more detailed embodiment. The substrate patterning method 300 can, for example, be implemented by the substrate patterning apparatus 100 of FIG. 1. In this method 300, an inkjet head sprays ink at 302 on a top surface of a substrate, and the spray results in an overspray of excess ink past an edge of the substrate. At 304, the overspray of excess ink is heated above room temperature. For example, excess ink comprised of wax can be heated to a range between about 25° C. to about 80° C. At this temperature range, the wax, which is originally in a solid phase at room temperature, is changed to a liquid phase with reduced viscosity. Accordingly, the heating causes the excess ink to flow.

The excess ink at the liquid phase is then removed at 306. In one embodiment, as explained in more detail below, the heated excess ink can flow away from a chuck assembly based on gravitational pull. In an alternate embodiment, as also explained in more detail below, a vacuum can be applied to the excess ink to convey or suck the excess ink away from the chuck assembly.

Figure 4:
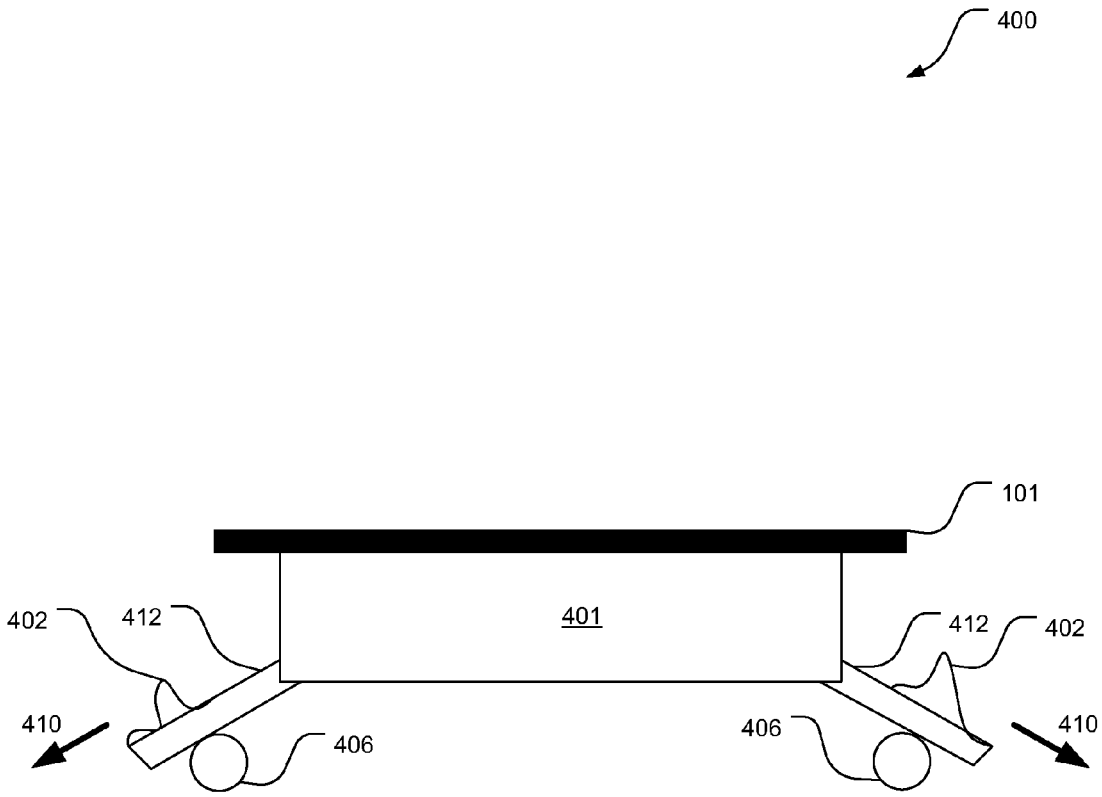
FIG. 4 depicts a diagram of an example of a chuck assembly, in accordance with an embodiment.

FIG. 4 depicts a diagram of an example of a chuck assembly 400, in accordance with an embodiment. This chuck assembly 400 includes a chuck 401, collectors 412, and heaters 406. The chuck 401 supports a substrate 101. The collectors 412 are located below the chuck 401 and collect an overspray of excess ink 402 sprayed past the edges of the substrate 101. In this embodiment, the heaters 406 are next to the collectors 412 and heat the collectors 412.

As depicted, the collectors 412 collect the overspray of excess ink 402, which, in this example, is comprised of wax. Over time, the collectors 412 accumulate a buildup of the excess ink 402. To remove the buildup of excess ink 402, the heaters 406 heat the collectors 412, which in turn heat the excess ink 402 accumulated on the collectors 412. The heating changes the viscosity of the excess ink 402 and particularly, changes it from a solid phase to a liquid phase with lower viscosity. This lower viscosity allows the excess ink 402 to flow, and the collectors 412 are sloped such that gravity conveys the flow of excess ink 412 along directions 410 away from the chuck assembly 400, thereby preventing buildup of the excess ink 402.

In addition to the sloped shape, the collectors 412 can have a variety of other different shapes or geometries, depending on the technique applied to remove the buildup of excess ink 402. For example, the collectors 412 can be in the shape of a trough or, in another example, can have a curved surface, as illustrated in more detail below.

Figure 5A:
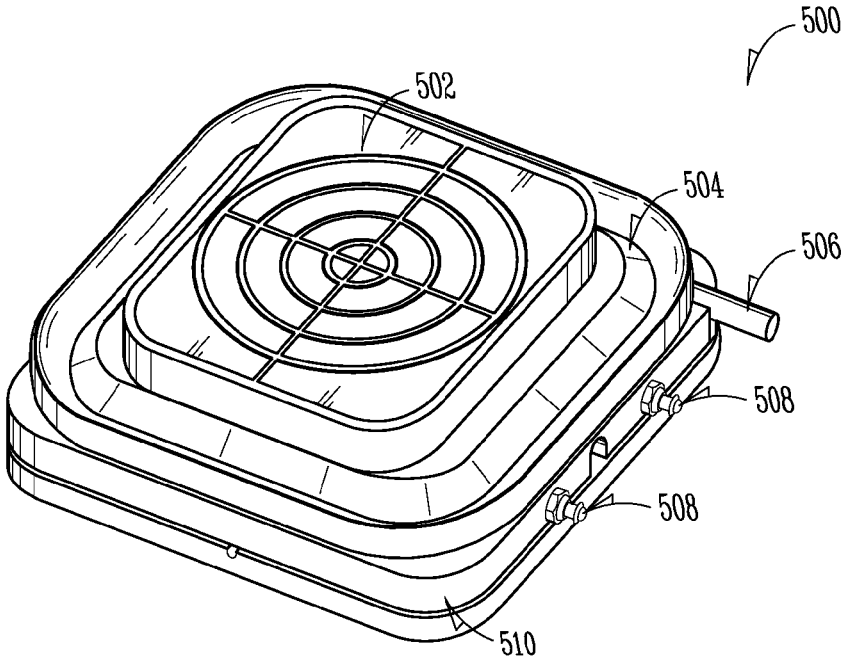
FIGS. 5A and 5B are diagrams depicting a different chuck assembly, in accordance with another embodiment.
Figure 5B:
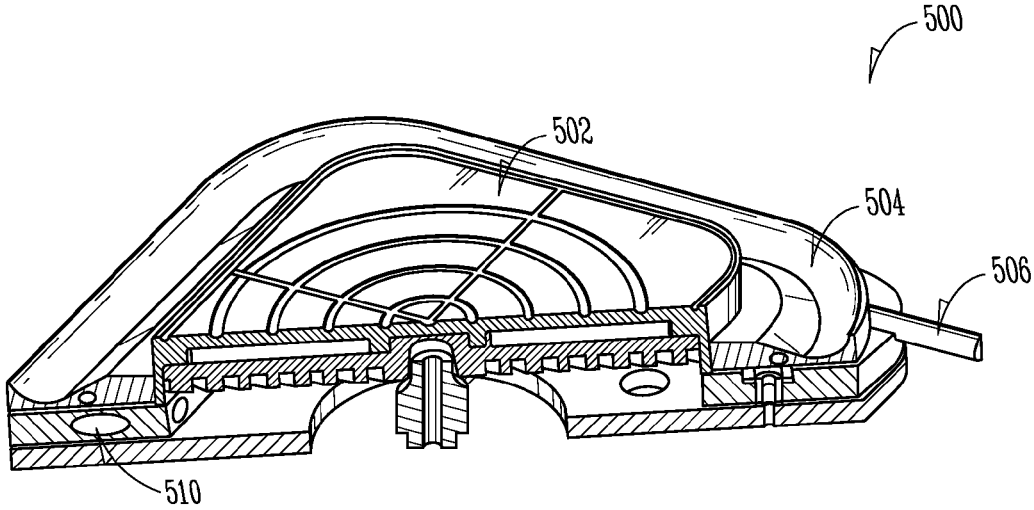

FIGS. 5A and 5B are diagrams depicting a different chuck assembly 500, in accordance with another embodiment. Particularly, FIG. 5A depicts a perspective view of the chuck assembly 500 while FIG. 5B depicts a sectional view of the same chuck assembly 500. As depicted, the chuck assembly 500 is comprised of a chuck 502, a trough 504, a heater 510, vacuum inlet 508, and a conduit outlet 506. The chuck 502 supports a substrate (not shown). The trough 504 is disposed below the chuck 502 and collects an overspray of excess ink sprayed past an edge of the substrate. The heater 510, which is disposed below and in contact with the trough 504, heats the trough 504.

The substrate can be held in place with the use of vacuum suction. In reference to FIG. 5A, the vacuum can be applied through vacuum inlets 508 to force the bottom surface of the substrate to adhere to a surface of the chuck 502. The trough 504 has a curved bottom that is configured to collect the excess ink from the overspray.

The ink can be a solid or a thick liquid that is non-flowing at room temperature. As an example, non-flowing ink can have a viscosity of about 10,000 CPS at room temperature. To remove the excess ink collected in the trough 504, the heater 510 heats the trough 504, thereby heating the excess ink. As a result, the viscosity of the heated excess ink is reduced such that the excess ink will flow within the trough 504. The heater 510 is continuous and heats the trough 504 uniformly, thereby possibly eliminating cold areas within the trough 504.

In the embodiment depicted in FIGS. 5A and 5B, the trough 504 comprises a conduit that receives the excess ink, which exits through the conduit outlet 506. In one embodiment, vacuum is applied through this conduit to draw the excess ink from the trough 404, thereby removing the excess ink away from the chuck assembly 500 by way of the conduit outlet 506. In an alternate embodiment (not depicted in FIGS. 5A and 5B), the trough 504 can be shaped to convey the excess ink away from the chuck assembly 500 by, for example, relying on gravity to channel the excess ink away from the chuck assembly 500. The trough 504, in one embodiment, can have a reflective surface that reflects light towards a bottom surface of the substrate, which is supported by the chuck 502. As explained in more detail below, the reflected light can assist in detecting the edges of the substrate.

Figure 6:
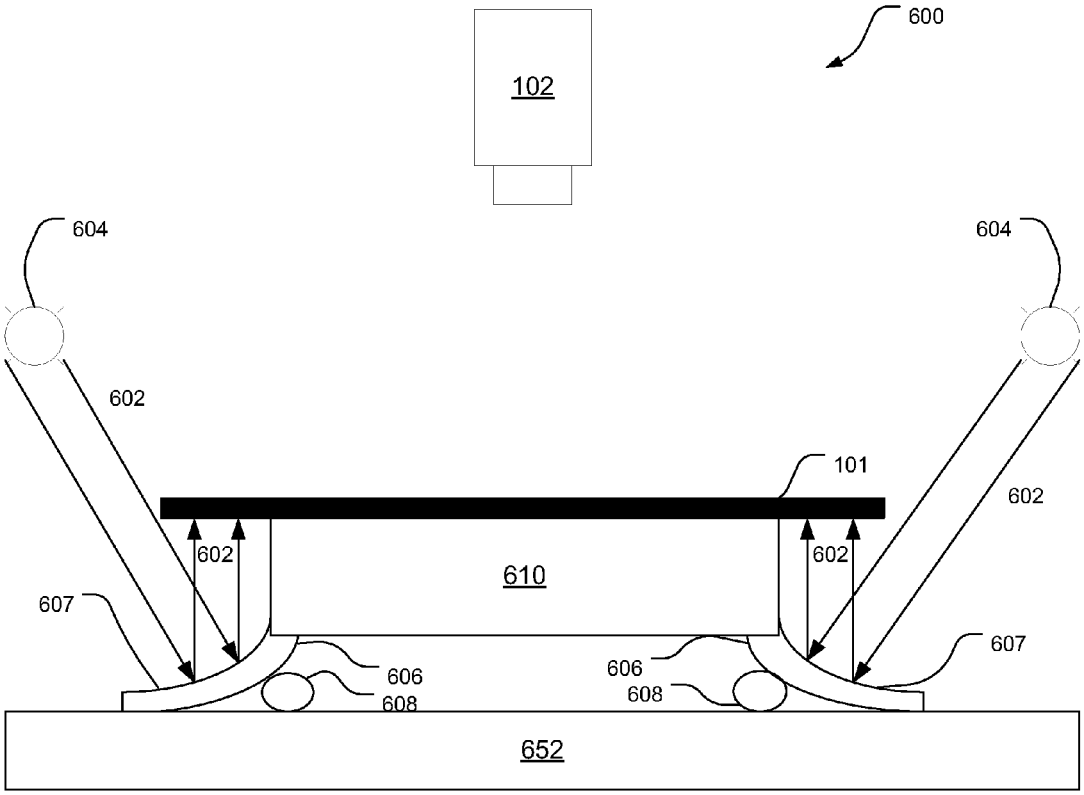
FIG. 6 depicts another example of a substrate patterning apparatus, in accordance with yet another embodiment.

FIG. 6 depicts another example of a substrate patterning apparatus 600, in accordance with yet another embodiment. Here, the substrate patterning apparatus 600 includes a chuck assembly, which includes chuck 610, collectors 606, and heaters 608. Additionally included in the substrate patterning apparatus 600 are light sources 604, an optical sensor 102, and a support structure 652. The chuck assembly is disposed above the support structure 652 and supports a substrate 101. The optical sensor 102 is disposed above the substrate 101 and receives light from a top surface of the substrate 101 as well from an opposite surface (or bottom surface) of the substrate 101. As depicted, the light sources 604 are located above the substrate 101, but it should be appreciated that the light sources 604, in other embodiments, can be located in different locations, such as below the support structure 652 and between the support structure 652 and the substrate 101

As discussed above, in the fabrication photovoltaic cells or other electronic devices, an image of the top surface of the substrate 101, as captured by the optical sensor 102, can be used to accurately position the substrate 101 relative to an inkjet head (not shown) such that the inkjet head can accurately spray the ink on the substrate 101. In particular, the image can need to show the edges of the substrate 101 such that the boundaries of the substrate can be identified or detected. In one example, the edges of the substrate 101 can be used as a reference when positioning the substrate 101.

To assist in the detection of the edges of the substrate 101, the light sources 604 can be included in the substrate patterning apparatus 600 to illuminate the edges, thereby providing a high contrast of the edges in the image. In particular, the light sources 604 light at least the bottom surface of the substrate 101. In the embodiment depicted in FIG. 6, the collectors 606 have reflective surfaces 607 that reflect light 602 from the light sources 604 to the bottom surface of the substrate 101. As a result, more light is directed at the bottom surface of the substrate 101, thereby possibly providing more contrast at the edges of the substrate 101 in the image.

It should also be noted that from the perspective of the optical sensor 102, the light 602 reflected from the reflective surfaces 607 is the same as the light 602 emitted from the light sources 604. In effect, the reflective surfaces 607 also provides light 602. Accordingly, as used herein, each of the reflective surfaces 607 can also be referred to as a "light source."

Figure 7:
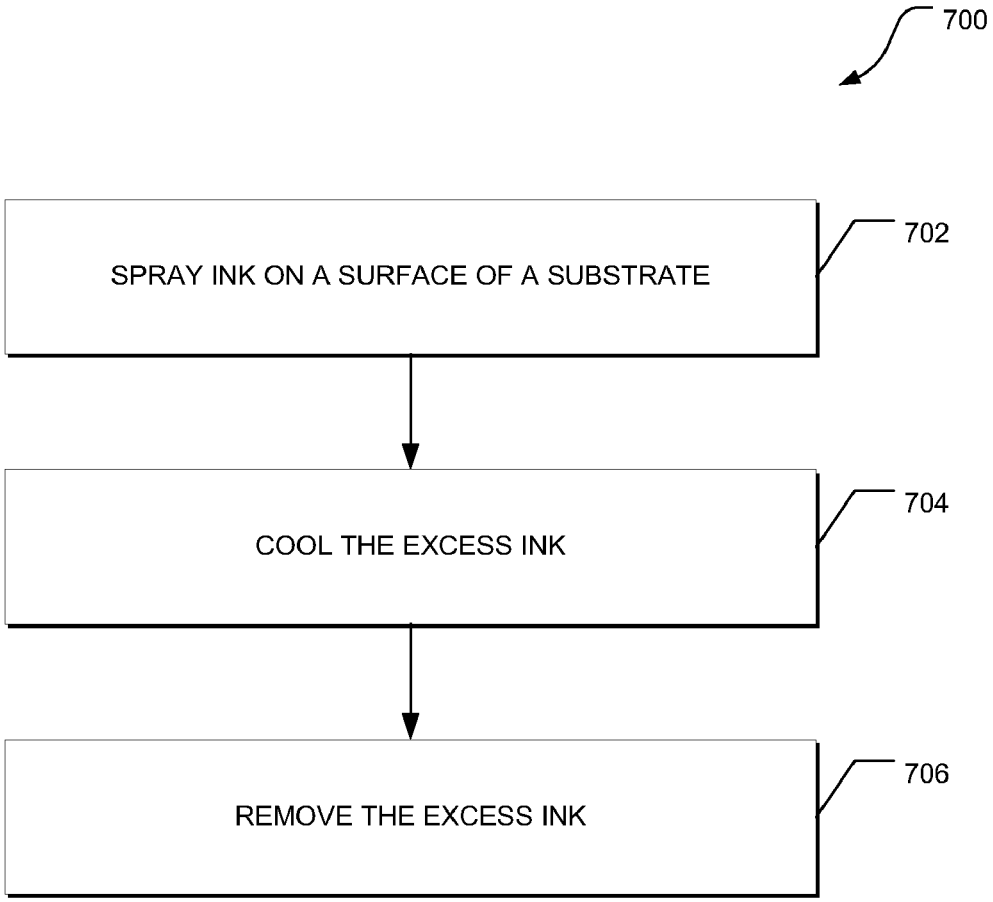
FIG. 7 depicts a flow diagram of a general overview of a substrate patterning method based on cooling the excess ink, in accordance with an example embodiment.

FIG. 7 depicts a flow diagram of a general overview of a substrate patterning method 700 based on cooling the excess ink, in accordance with an example embodiment. In this method 700, the inkjet head sprays ink on a top surface of the substrate at 702, and the spray results in an overspray of excess ink past the edges of the substrate. In this embodiment, the excess ink is cooled at 704 such that, for example, the viscosity of the excess ink increases. In one example, the excess ink can be changed from a liquid phase to a solid phase, which has infinite viscosity. Depending on the type of ink used, the excess ink can be more easily removed at the solid phase. For example, the excess ink can be hardened when cooled such that it does not stick to the collector of a chuck assembly.

After the excess ink is cooled, the excess ink can be removed at 706. In one embodiment, the excess ink can be removed by applying a vacuum to draw away the cooled excess ink. In another embodiment, the excess ink can be removed by applying a current of air to the cooled excess ink, as explained in more detail below.

Figure 8:
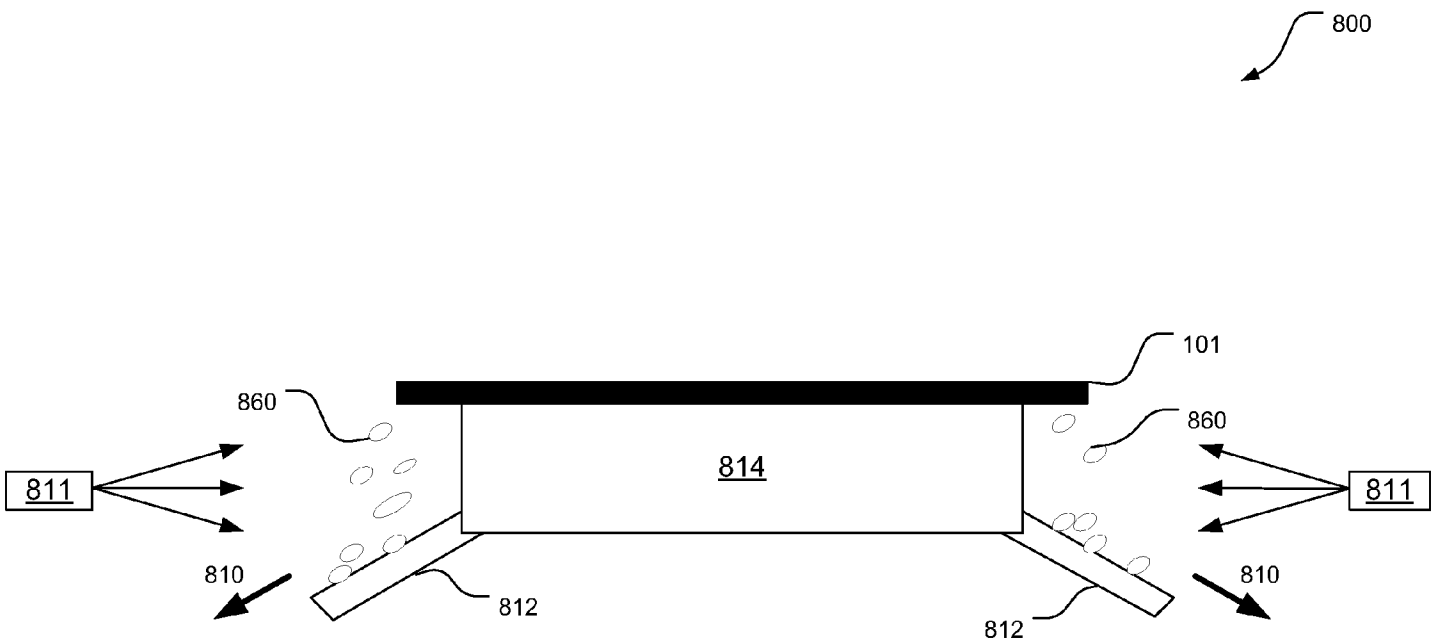
FIG. 8 depicts another example of a substrate patterning apparatus, in accordance with another embodiment.

FIG. 8 depicts another example of a substrate patterning apparatus 800, in accordance with another embodiment. As depicted, the substrate patterning apparatus 800 includes a chuck assembly, which is comprised of collectors 812, a chuck 814, and coolers 811. The chuck 814 supports a substrate 101.

As depicted, the collectors 812 collect the overspray of excess ink 860. However, the excess ink is cooled such that it changes into a different phase before it makes contact with the collectors 812. In particular, the coolers 811 emit a current of cool air or other gas that cools the excess ink in midair. In an example where the excess ink is in a liquid phase, the cooling of the excess ink causes the liquid phase to change to a solid phase in midair. As a result, for example, the excess ink can be frozen, semi frozen, or partially frozen before it makes contact with the collectors 812.

The collectors 812 collect the cooled excess ink and if the excess ink 860 has cooled, it will not adhere to the surfaces of the collectors 812. In the embodiment depicted in FIG. 8, the collectors 812 are sloped such that gravity conveys the cooled excess ink 860 (or even excess ink 860 that is heated or at room temperature) along directions 810 away from the chuck assembly, thereby preventing buildup of the excess ink 860.

In the foregoing detailed description, various features are occasionally grouped together in a single embodiment for the purpose of streamlining the disclosure. This method of disclosure is not to be interpreted as reflecting an intention that the claimed embodiments of the subject matter require more features than are expressly recited in each claim. Rather, as the following claims reflect, the invention may lie in less than all features of a single disclosed embodiment. Thus the following claims are hereby incorporated into the detailed description, with each claim standing on its own as a separate preferred embodiment.

Plural instances may be provided for components, operations or structures described herein as a single instance. Finally, boundaries between various components, operations, and data stores are somewhat arbitrary, and particular operations are illustrated in the context of specific illustrative configurations. Other allocations of functionality are envisioned and may fall within the scope of the invention(s). In general, structures and functionality presented as separate components in the exemplary configurations may be implemented as a combined structure or component. Similarly, structures and functionality presented as a single component may be implemented as separate components. These and other variations, modifications, additions, and improvements fall within the scope of the invention(s).

What is claimed is:

1. A substrate patterning method comprising:

spraying ink on a surface of a substrate, the spraying of the ink resulting in an overspray of excess ink past an edge of the substrate;

changing a temperature of the excess ink to cause a change in a viscosity of the excess ink; and removing the excess ink having the changed viscosity;

wherein the changing of the temperature of the excess ink causes a phase of the excess ink to change from a first phase to a second phase that is different from the first phase; wherein the changing of the temperature comprises heating the excess ink above room temperature; and wherein a first phase of the excess ink is a solid phase and wherein a second phase of the excess ink is a liquid phase, wherein the heating of the excess ink causes the solid phase to change to the liquid phase; and wherein the removal of the overspray comprises applying a vacuum to the excess ink.

2. The substrate patterning method of claim 1, wherein the changing of the temperature of the excess ink comprises cooling the excess ink.

3. The substrate patterning method of claim 2, wherein a first phase of the excess ink is a liquid phase and a second phase of the excess ink is a solid phase, and wherein the cooling of the excess ink causes the liquid phase to change to the solid phase.

4. The substrate patterning method of claim 3, wherein the excess ink is changed to the solid phase in midair.

5. The substrate patterning method of claim 1, wherein the removal of the overspray comprises applying a current of air to the excess ink.

6. The substrate patterning method of claim 1, wherein the ink comprises wax that is used as a masking material in at least one of an etching process or an electroplating process.

* * * * *